US006931245B2

(12) United States Patent
Fikart

(10) Patent No.: US 6,931,245 B2
(45) Date of Patent: Aug. 16, 2005

(54) DOWNCONVERTER FOR THE COMBINED RECEPTION OF LINEAR AND CIRCULAR POLARIZATION SIGNALS FROM COLLOCATED SATELLITES

(75) Inventor: Josef Ludvik Fikart, Port Moody (CA)

(73) Assignee: Norsat International Inc., Burnaby (CA)

( * ) Notice: Subject to any disclaimer, the term of this patent is extended or adjusted under 35 U.S.C. 154(b) by 419 days.

(21) Appl. No.: 10/215,032

(22) Filed: Aug. 9, 2002

(65) Prior Publication Data

US 2004/0029549 A1 Feb. 12, 2004

(51) Int. Cl.[7] ..... H04B 1/26

(52) U.S. Cl. ..... 455/323; 455/3.02; 455/12.1; 343/756

(58) Field of Search ..... 455/323, 12.1, 455/3.02, 21, 131, 13.1, 22, 23; 370/310, 330; 343/756

(56) References Cited

U.S. PATENT DOCUMENTS

| | | | | | |
|---|---|---|---|---|---|
| 2,546,840 | A | | 3/1951 | Tyrrell et al. | |
| 3,758,882 | A | | 9/1973 | Morz | |
| 3,768,888 | A | | 10/1973 | Nishino et al. | |
| 4,523,180 | A | | 6/1985 | Kuboki et al. | |
| 4,686,537 | A | | 8/1987 | Hidaka et al. | |
| 4,920,351 | A | | 4/1990 | Bartlett et al. | |
| 5,038,150 | A | | 8/1991 | Bains | |
| 5,555,257 | A | * | 9/1996 | Dent | 370/319 |
| 5,568,158 | A | * | 10/1996 | Gould | 343/756 |
| 5,619,503 | A | * | 4/1997 | Dent | 370/330 |
| 5,724,050 | A | | 3/1998 | Tokuda et al. | |
| 5,812,947 | A | * | 9/1998 | Dent | 455/427 |
| 5,848,060 | A | * | 12/1998 | Dent | 370/281 |
| 6,483,472 | B2 | * | 11/2002 | Cipolla et al. | 343/765 |
| 6,535,169 | B2 | * | 3/2003 | Fourdeux et al. | 343/700 MS |
| 2004/0110463 | A1 | * | 6/2004 | Perlman | 455/3.02 |
| 2004/0110466 | A1 | * | 6/2004 | Perlman | 455/12.1 |
| 2004/0110468 | A1 | * | 6/2004 | Perlman | 455/13.3 |

* cited by examiner

*Primary Examiner*—Sonny Trinh
(74) *Attorney, Agent, or Firm*—Vermette & Co.

(57) ABSTRACT

A microwave downconverter apparatus and scheme is hereby presented for the simultaneous reception of both linearly and circularly polarized signals from collocated satellites. A single antenna and waveguide feed is used for reception from two collocated satellites, wherein one satellite employs both right and left hand circular polarizations and the other employs both vertical and horizontal linear polarizations. The vertical and horizontal components of the linearly polarized signals and the vertical and horizontal components of the circularly polarized signals are separated by the antenna feed apparatus and applied to the input of the downconverter of this invention. Following a stage of RF amplification, both the horizontal and vertical components are further separated into two distinct paths by means of a diplexer. Since the linearly and circularly polarized signals are displaced one from the other by means of frequency, the diplexer provides a means of separating the two polarization techniques. The vertical and horizontal components of the linearly polarized signals are then downconverted to an intermediate frequency by means of a local oscillator and mixers. The vertical and horizontal components of the circularly polarized signals are likewise downconverted to an intermediate frequency.

21 Claims, 3 Drawing Sheets

DOWNCONVERTER FOR THE COMBINED RECEPTION OF LINEAR AND CIRCULAR POLARIZATION SIGNALS FROM COLLOCATED SATELLITES

FIELD

This invention relates generally to the simultaneous downconversion of dual linearly polarized and dual circularly polarized signals from co-located satellites. More specifically, the invention relates to the reception and downconversion of such multiple polarizations in a single low noise block downconverter (LNB).

BACKGROUND OF THE INVENTION

In order to increase the bandwidth of microwave-based communications systems, it is common practice to employ polarization technologies that effectively double the utilization of a given spectrum. Two basic categories of polarization are linear polarization and circular polarization. Linear polarization contains two orthogonal components, vertical and horizontal. Circularly polarized signals contain both vertical and horizontal components separated by a 90-degree phase difference. Whether or not a circularly polarized signal is considered to be polarized in a right hand sense or a left-hand sense is dependent on which of the two components, vertical and horizontal, leads the other in phase. Since linearly and circularly polarized signals both have vertical and horizontal components, it is not possible to further increase the capacity of communications systems by employing both linear and circular polarization on the same frequency.

In a typical microwave receiver, linearly polarized signals are separated in a waveguide by orthogonally located probes. The signals are then processed independently. In the case of circular polarization, an additional processing step is needed to separate the Right-hand polarized and Left-hand polarized signals. It is common practice in circularly polarized receiving systems to employ a waveguide polarizer, placed between the antenna output and the waveguide section containing the orthogonal probes. This polarizer converts the vertical and horizontal components of a given circularly polarized signal into a single component that emerges either at the vertical probe or the horizontal probe, depending on the sense of circular polarization. It is also possible to effect this conversion of the vertical and horizontal components of circularly polarized signals by means of a 90-degree combiner located after the components have been picked-up by the vertical and horizontal probes. In an embodiment comprising a 90-degree combiner, the antenna output is connected directly to the waveguide section containing the probes, as is the case in linearly polarized systems.

In the use of satellites for the broadcast of, for example, television signals, there are instances where two satellites are collocated in space, and transmitting on different frequencies. In many cases these frequencies are close enough that they can be received by one antenna and one low noise block downconverter (LNB). An example would be the Galaxy satellite, which transmits linearly polarized signals in the band 10.95–11.2 GHz, and the Nimiq satellite, which is collocated with the Galaxy satellite and transmits circularly polarized signals in the band 12.2–12.7 GHz. However, because the two satellites have different polarization schemes, the prior art LNB technologies require two separate and distinct antenna/LNB assemblies, one for linear polarization and one for circular polarization.

For this reason, it can be appreciated that it is desirable to have a single antenna and LNB system, which is capable of simultaneously receiving R.F. signals of both linear and circular polarizations.

It is an object of this invention to provide an apparatus for downconverting both dual polarized linear and dual polarized circular microwave signals in a single antenna/LNB apparatus, and for providing separate outputs for all senses of polarization It is a further object of this invention to provide an apparatus for switching of all available senses of polarization in order to obtain all such senses of polarization at any one of a multiplicity of outputs.

SUMMARY OF THE INVENTION

These and other objects of the invention are realized in a new and improved low noise block (LNB) downconverter for the simultaneous reception of dual linearly and circularly polarized microwave signals of different frequencies from a satellite. In one embodiment of the present invention, the LNB incorporates two probes at the input, one of which receives the vertical components of the incoming signals and the other receives the horizontal components, without differentiating between linearly or circularly polarized signals. Each of these components is first amplified in an amplifier stage. The outputs of said amplifier stage are then separated by means of diplexers into two distinct frequency ranges or bands, one corresponding to the signals received which have linear polarization and the other corresponding to the signals which have circular polarization. The vertical and horizontal components of the linearly polarized signals are then applied to a pair of downconverting mixers, connected to a common local oscillator. The frequency of said local oscillator is such that the output frequency from the mixer will be the desired intermediate frequency.

The other outputs from the aforementioned diplexers consist of the vertical and horizontal components of the circularly polarized signals. In order to isolate and combine the vertical and horizontal components of the circularly polarized signals such that the left-hand circularly polarized signal can be separated from the right-hand circularly polarized signal, it is necessary to align the two components in phase and then sum them. This is achieved by means of a 90-degree combiner. The output from the combiner is then applied to a pair of downconverting mixers, connected to a common local oscillator. The frequency of said local oscillator is such that the output frequency from the mixer will be the desired intermediate frequency.

By this means, four separate outputs are provided, each dedicated to one of the four polarized signals; namely, Vertical, Linear, Horizontal Linear, Left-Hand Circular, and Right-Hand Circular.

In an alternative embodiment, the basic elements of this invention are incorporated into a LNB downconverter configuration that contains two intermediate frequency outputs, each of which can be switched to any one of the four polarized signals: Vertical Linear, Horizontal Linear, Left-Hand Circular, and Right-Hand Circular. In this alternative embodiment, the four outputs of the embodiment described above are further divided into a multiplicity of individual outputs. These outputs are then connected to an array of switches, which, by means of combinations of selected outputs, permit the selection of any one of the polarized signals at either of two outputs.

BRIEF DESCRIPTION OF THE DRAWINGS

Other objects, features, aspects and advantages of the present invention will become apparent to those of ordinary skill from the following detailed description of the invention taken in conjunction with the accompanying drawings, in which.

DETAILED DESCRIPTION OF THE INVENTION

Figure 1:
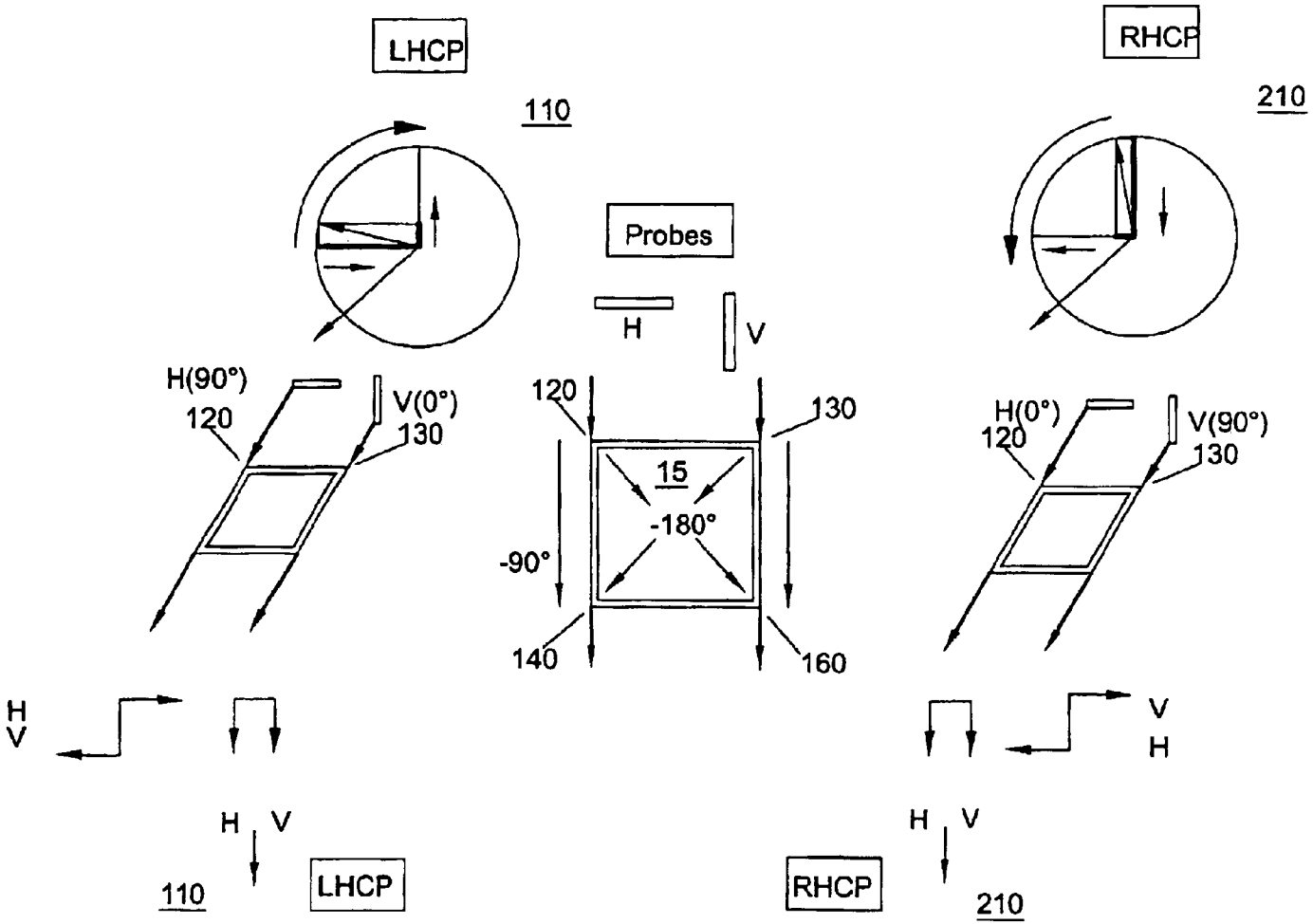
FIG. 1 describes how circularly polarized signals of different polarization senses can be separated by using two probes and a 90-degree combiner.

In FIG. 1 is depicted a schematic of the means used for converting the vertical and horizontal components of circularly polarized signals into the left-hand circular and right hand circular signals, which in the preferred embodiment is a 90° combiner. It will be noted that a circularly polarized signal has both vertical and horizontal components, however, the two components are in quadrature, i.e. phased 90 degrees with respect to each other. In other words, when one component goes through zero, the other is at its maximum. Depending on which one of the two components leads the other, the result is Right Hand Circular Polarization (RHCP) 210 or Left Hand Circular Polarization (LHCP) 110.

In the present invention the vertical and horizontal components of the right hand and left hand circularly polarized signals, which have been picked up by the vertical and horizontal probes, are routed to a 90-degree combiner 15. Due to the additional phase shifts in the combiner 15, and depending on the lead or lag of the vertical signal component 130 compared to the horizontal signal component 120, the two components 120, 130 add in phase at one output port of the combiner 15 and cancel at the other port.

For example, referring again to FIG. 1, in the case of LHCP 110 the horizontal component is ahead of the vertical component by 90 degrees. The horizontal signal component 120 reaches the left output 140 of the combiner 15 through just one leg of the combiner 15 (a line with a 90 degree delay), resulting in a final phase angle of 90−90=0 degrees. The vertical signal component 130 gets to the left output 140 via two legs, resulting in a final phase angle of 0−180=−180 degrees. Therefore, the two contributions to the left output 140 are out of phase, thus canceling each other. As seen in FIG. 1, the situation is reversed for the right output 160 of the combiner 15. The horizontal signal component 120 encounters a delay of 180 degrees (two legs), resulting in a final phase angle of 90−180=−90 degrees. The vertical signal component 130 gets to the right output 160 through just one leg with a 90 degree delay, resulting in a final phase angle of 0−90=−90 degrees. Therefore the two contributions to the right output 160 are in phase, thus adding for maximum output.

The opposite is true for the RHCP 210 as shown in FIG. 1. In the case of RHCP 210 the vertical component is ahead of the horizontal component by 90 degrees. The vertical signal component 130 reaches the right output 160 of the combiner 15 through just one leg of the combiner 15 (a line with a 90 degree delay), resulting in a final phase angle of 90−90=0 degrees. The horizontal signal component 120 gets to the right output 160 via two legs, resulting in a final phase angle of 0−180=−180 degrees. Therefore, the two contributions to the right output 160 are out of phase thus canceling each other. As seen in FIG. 1, the situation is reversed for the left output 140 of the combiner 15. The vertical signal component 130 encounters a delay of 180 degrees (two legs), resulting in a final phase angle of 90−180=−90 degrees. The horizontal signal component 120 gets to the left output 140 through just one leg with a 90 degree delay, resulting in a final phase angle of 0−90=−90 degrees. Therefore the two contributions to the left output 140 are in phase, thus adding for maximum output. In total, it can be seen that the LHCP 110 signal emerges at the right output 160 of the combiner 15 and the RHCP 210 signal emerges at the left output 140. In this way, the two signals are recovered and separated.

Figure 2:
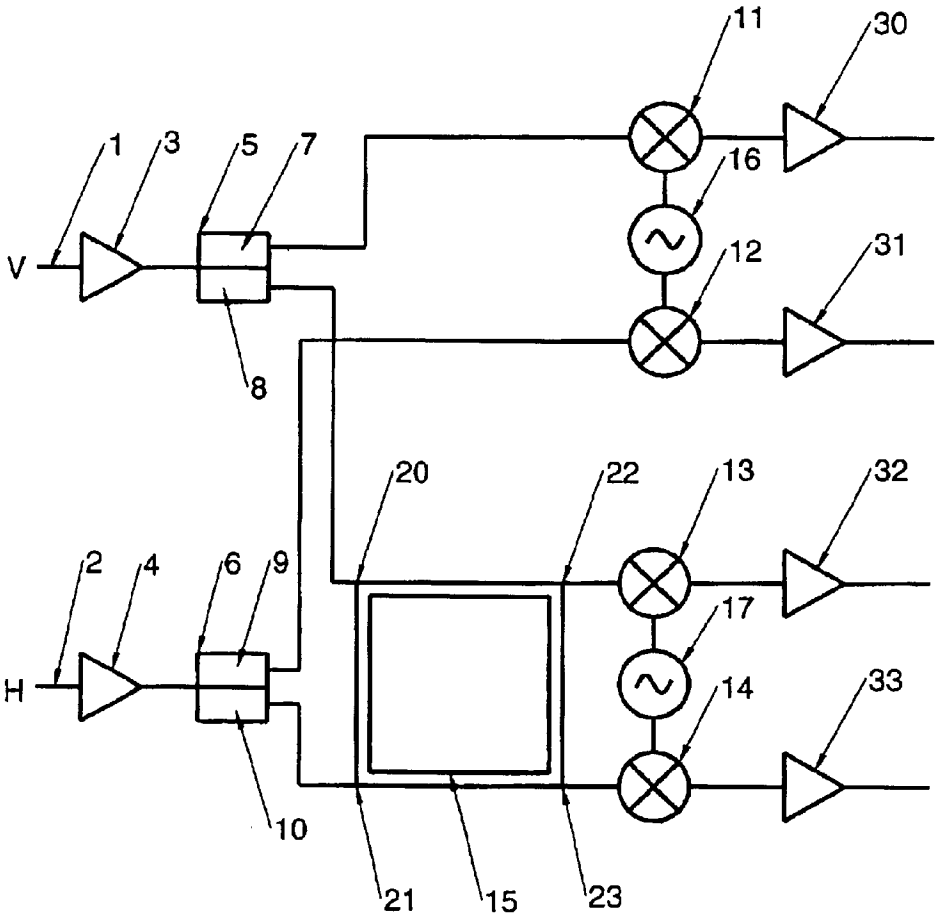
FIG. 2 is a block diagram of the dual-polarization downconverter scheme with four outputs, each dedicated to one each of the four possible types of polarization.

Referring to FIG. 2., a diagram of the preferred embodiment of the present invention 100 is shown. The input to this invention consists of two separate inputs 1 and 2. Input 1 is derived from a probe in a waveguide, which selects all vertical polarization components of the linearly and circularly polarized signals. Similarly, input 2 is derived from a probe in the waveguide, which selects all horizontal polarization components of the linearly and circularly polarized signals. Each input 1 and input 2 contains the signals present in the frequency bands 10.95–11.2 GHz and 12.2–12.7 GHz. These frequencies are used for purpose of explanation only; it will be readily appreciated by anyone skilled in the art that the present invention is applicable to any of a wide number of frequencies.

Within the apparatus 100, that is the subject of this invention, inputs 1 and 2 are connected to RF-Amps 3 and 4. The purpose of these RF-Amps 3 and 4 is to increase the signal levels prior to further processing. The outputs of RF-Amps 3 and 4 are connected to diplexers 5 and 6 respectively. Diplexer 5 can be seen to consist of a low pass filter (LPF) 7 and a high pass filter (HPF) 8. Similarly, diplexer 6 can be seen to consist of a LPF 9 and a HPF 10. The output of LPF 7 is then routed to mixer 11. The output of HPF 8 is routed to port 20 of the 90-degree combiner 15. The output from LPF 9 is routed to mixer 12. The output from HPF 10 is routed to port 21 of the 90-degree combiner 15. Outputs 22 and 23 of 90-degree combiner 15 are connected respectively to mixers 13 and 14.

In order to provide a signal for downconversion of the input frequencies related to the linearly polarized signals, local oscillator 16 is provided. The outputs of local oscillator 16 are connected to mixers 11 and 12. The mixers 11 and 12 are operative to downconvert the input frequencies to the frequency range 1200 MHz to 1450 MHz.

The output of mixer 11 is then amplified in IF-Amp 30. The output from IF-Amp 30 is designated as the Linear Vertically Polarized signal.

The output of mixer 12 is then amplified in IF-Amp 31. The output from IF-Amp 31 is designated as the Linear Horizontally Polarized signal.

Similarly, in order to provide a signal for downconversion from the input frequencies related to the circularly polarized signals, local oscillator 17 is provided. The outputs of local oscillator 17 are connected to mixers 13 and 14. Mixers 13 and 14 are operative to downconvert the input frequencies to the frequency range 1600 MHz to 2100 MHz.

The output of mixer 13 is then amplified in IF-Amp 32. The output from IF-Amp 32 is designated as the Left Hand Circular Polarized signal.

The output of mixer 14 is then amplified in IF-Amp 33. The output from IF-Amp 33 is designated as the Right Hand Circular Polarized signal.

In light of the foregoing, it will be appreciated that the specific types or models of the various components comprising the present LNB downconverter system 100 are not critical or limiting to either the scope or practice of the present invention. Since the hardware implementation of these various components will be easily and readily accessible to those skilled in the art of microwave systems, they are only referred to generically in the present description. In this regard, it will become apparent that the novelty of the present invention resides primarily in a unique combination and architectural configuration of these various components in order to facilitate the simultaneous recovery of orthogonal linearly polarized signals and opposite-sense circularly polarized signals, through a single low noise block downconverter, utilizing a single antenna system, rather than two separate antenna systems, each with its own LNB, or a single antenna with a waveguide diplexer feeding two LNBs, as required by the prior art.

Figure 3:
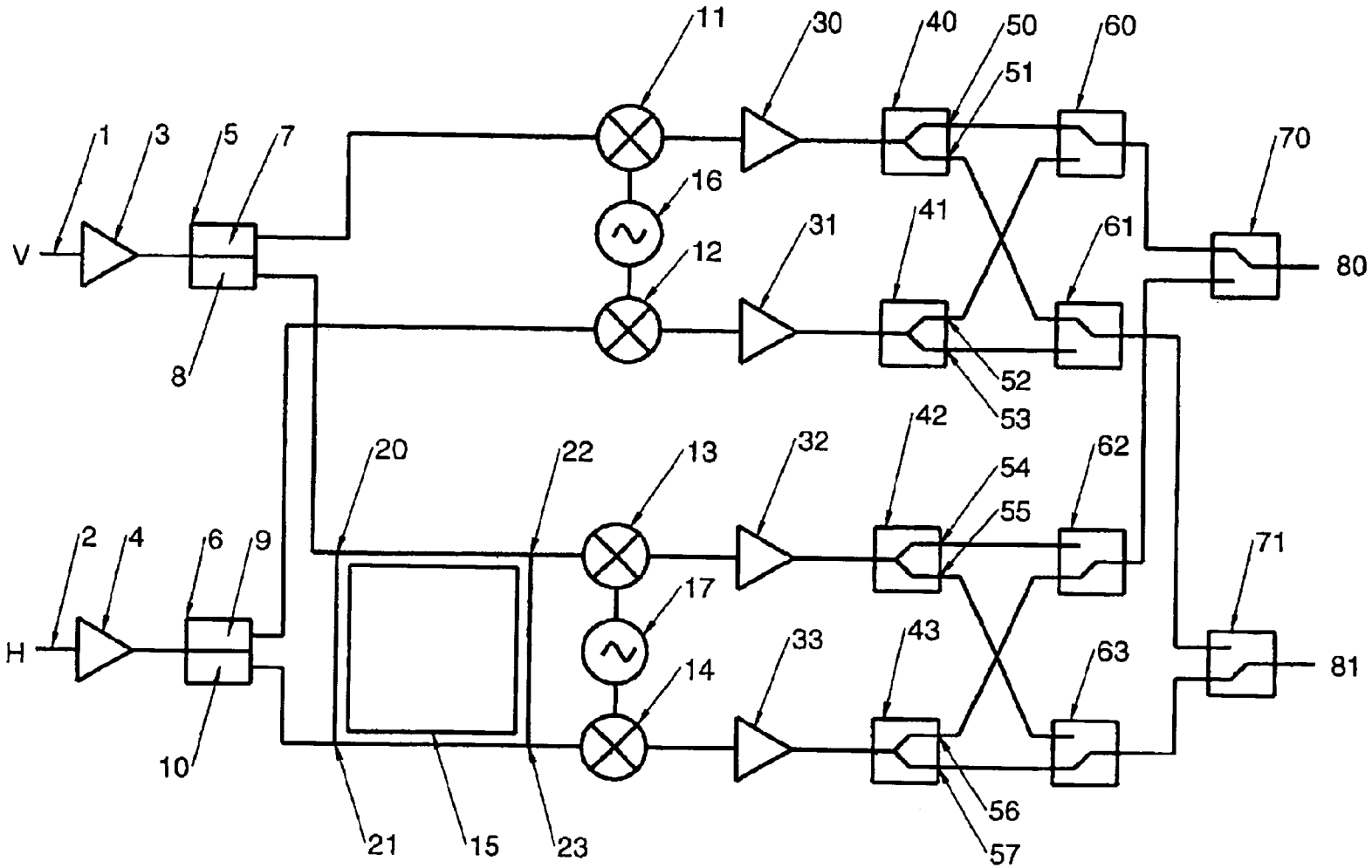
FIG. 3 is a block diagram of the dual polarization downconverter adapted to enable each of its two outputs to be switchable to one of the four types of linear and circular polarizations that can be received by this invention.

In an alternative embodiment, as is illustrated in FIG. 3, the present invention can also employ a switching means to enable any one of the four possible polarizations namely, Vertical Linear, Horizontal Linear, Left-Hand Circular, and Right-Hand Circular to be obtained at either of two output ports.

The embodiment of FIG. 3 is identical to that of FIG. 4, however, it comprises additional elements that are described in detail below. The output of IF-Amp 30 is connected to a splitter 40, which provides two identical outputs 50 and 51. Output 50 is connected to one contact of a single pole, double throw (SPDT) switch 60. Output 51 is connected to one contact of an adjacent SPDT switch 61. Similarly, the output of IF-Amp 31 is connected to a splitter 41, which provides two identical outputs 52 and 53. Output 52 is connected to the other contact of the single pole, double throw (SPDT) switch 60. Output 53 is connected to the other contact of the adjacent SPDT switch 61.

Similarly, the output of IF-Amp 32 is connected to a splitter 42, which provides two identical outputs 54 and 55. Output 54 is connected to one contact of a single pole, double throw (SPDT) switch 62. Output 55 is connected to one contact of an adjacent SPDT switch 63. Similarly, the output of IF-Amp 33 is connected to a splitter 43, which provides two identical outputs 56 and 57. Output 56 is connected to the other contact of the single pole, double throw (SPDT) switch 62. Output 57 is connected to the other contact of an adjacent SPDT switch 63.

In a like manner, the common poles of SPDT switches 60, 61, 62, and 63 are further interconnected as described as follows. The common pole output of SPDT switch 60 is connected to one contact of SPDT switch 70. The common pole output of SPDT switch 62 is connected to the other contact of SPDT switch 70. Likewise, the common pole output of SPDT switch 61 is connected to one contact of SPDT switch 71. The common pole output of SPDT switch 63 is connected to the other contact of SPDT switch 71.

It will be readily apparent to those skilled in the art that the array of switches comprising SPDT switches 60, 61, 62, 63, 70, and 71, permits either or both of output 1 and output 2 80, 81 to contain any of the four possible polarizations, namely Vertical Linear, Horizontal Linear, Left-Hand Circular, and Right-Hand Circular.

Further, with reference to FIGS. 2 and 3, an embodiment of the present invention may be constructed by incorporating diplexers 5 and 6 and combiner 15 into prior art low noise block (LNB) downconverters.

The above-mentioned embodiments should be regarded as illustrative rather than restrictive, and it should be appreciated that variations may be made other than those specifically discussed, by workers of ordinary skill in the art, without departing from the scope of the present invention as defined by the following claims:

What is claimed is:

1. An apparatus for downconversion of linearly and circularly polarized signals, wherein the linearly polarized signals have a different frequency than the circularly polarized signals, said apparatus for use in conjunction with an antenna or waveguide, said antenna or waveguide operative to receive vertically and horizontally polarized components of said linearly and circularly polarized signals, said apparatus comprising:

(a) a first LNB input and a second LNB input, said first LNB input operative to receive the vertically polarized components of the linearly and circularly polarized signals and said second LNB input operative to receive the horizontally polarized components of the linearly and circularly polarized signals;

(b) a first amplifier and a second amplifier coupled to said first LNB input and said second LNB input, respectively, said first amplifier operative to receive and amplify a signal from said first LNB input and said second amplifier operative to receive and amplify a signal from said second LNB input;

(c) a first diplexer coupled to said first amplifier, said first diplexer comprising a low pass filter and a high pass filter, said first diplexer operative to receive said signal from said first amplifier and to separate said signal from said first amplifier into a first frequency band and a second frequency band, said first frequency band corresponding to said linearly polarized signal and said second frequency band corresponding to said circularly polarized signal, said first diplexer additionally having a first output and a second output, said first output for outputting said first frequency band and said second output for outputting said second frequency band;

(d) a second diplexer coupled to said second amplifier, said second diplexer comprising a low pass filter and a high pass filter, said second diplexer operative to receive said signal from said second amplifier and to separate said signal from said second amplifier into a first frequency band and a second frequency band, said first frequency band corresponding to said linearly polarized signal and said second frequency band corresponding to said circularly polarized signal, said second diplexer additionally having a first output and a second output, said first output for outputting said first frequency band and said second output for outputting said second frequency band;

(e) a pair of linear mixers, each one of said pair of linear mixers coupled to a first local oscillator, a first mixer of said pair of linear mixers having an input coupled to said first output of said first diplexer, and a second mixer of said pair of linear mixers having an input coupled to said first output of said second diplexer, said pair of linear mixers operative to downconvert said first frequency bands from said first outputs of said first and second diplexers;

(f) a 90 degree combiner having a first input and a second input, said first and second inputs coupled to said second outputs of said first and second diplexers, respectively, said 90 degree combiner operative to introduce phase shifts into the signals entering said first and second inputs so as to separate left-hand and right-hand circularly polarized signals of said circularly polarized signals, said 90 degree combiner having a first output and a second output, said first output for outputting said left-hand circularly polarized signal and said second output for outputting said right-hand circularly polarized signal; and (g) a pair of circular mixers, each one of said pair of circular mixers coupled to a second local oscillator, a first mixer of said pair of circular mixers having an input coupled to said first output of said 90 degree combiner, and a second mixer of said pair of circular mixers having an input coupled to said second output of said 90 degree combiner, said pair of circular mixers operative to downconvert said left-hand and right-hand circularly polarized signals.

2. The apparatus of claim 1, further comprising a waveguide having a first probe and a second probe, said first probe for receiving the vertically polarized components and said second probe for receiving the horizontally polarized components, wherein said first probe is coupled to said first input and said second probe is coupled to said second input.

3. The apparatus of claim 1, further comprising first, second, third and fourth intermediate frequency amplifiers, wherein an output of each one of said circular mixers and said linear mixers is coupled to one of said intermediate frequency amplifiers.

4. The apparatus of claim 3, further comprising:

a) a first splitter, wherein an input of said first splitter is coupled to said first intermediate frequency amplifier, said first splitter having a first output and a second output;

b) a second splitter, wherein an input of said second splitter is coupled to said second intermediate frequency amplifier, said second splitter having a first output and a second output;

c) a third splitter, wherein an input of said third splitter is coupled to said third intermediate frequency amplifier, said third splitter having a first output and a second output; and d) a fourth splitter, wherein an input of said third splitter is coupled to said third intermediate frequency amplifier, said fourth splitter having a first output and a second output.

5. The apparatus of claim 4, further comprising:

a) a first switch having an output and a first input and a second input, said first input coupled to said first output of said first splitter, and said second input coupled to said first output of said second splitter;

b) a second switch having an output and a first input and a second input, said first input coupled to said second output of said first splitter, and said second input coupled to said second output of said second splitter;

c) a third switch having an output and a first input and a second input, said first input coupled to said first output of said third splitter, and said second input coupled to said first output of said fourth splitter; and d) a fourth switch having an output and a first input and a second input, said first input coupled to said second output of said third splitter, and said second input coupled to said second output of said fourth splitter.

6. The apparatus according to claim 5, said apparatus further comprising:

a) a first secondary switch having an output and a first input and a second input, said first input coupled to said output of the first switch, and said second input coupled to said output of said third switch; and b) a second secondary switch having an output and a first input and a second input, said first input coupled to said output of the first switch, and said second input coupled to said output of said fourth switch.

7. An apparatus according to claim 6, wherein said apparatus is operative to selectively output two of the following: the right hand circularly polarized signal, the left hand circularly polarized signal, the vertically polarized signal and the horizontally polarized signal.

8. The apparatus of claim 1, wherein said apparatus is operative to downconvert a linearly polarized signal having a frequency in a range of 10.95–11.2 GHz and a circularly polarized signal having a frequency in a range of 12.2–12.7 GHz.

9. The apparatus of claim 1, wherein said apparatus is operative to downconvert linearly and circularly polarized signals transmitted by a single satellite.

10. The apparatus of claim 1, wherein said apparatus is operative to simultaneously downconvert a right-hand circularly polarized signal, a left-hand circularly polarized signal, a vertical linearly polarized signal, and a horizontal linearly polarized signal.

11. The apparatus of claim 1, wherein said apparatus is operative to simultaneously downconvert a plurality of signals, wherein each one of said plurality of signals is a different one of a right-hand circularly polarized signal, a left-hand circularly polarized signal, a vertical linearly polarized signal, and a horizontal linearly polarized signal.

12. The apparatus of claim 1, wherein the linearly polarized signal is of a lower frequency than the circularly polarized signal, and wherein said first outputs of said first and second diplexers are coupled to said low pass filters of said first and second diplexers, and said second outputs of said first and second diplexers are coupled to said high pass filters of said first and second diplexers.

13. The apparatus of claim 1, wherein said apparatus is operative to downconvert the linearly polarized signal to 1200–1450 MHz and to downconvert the circularly polarized signal to 1600–2100 MHz.

14. A method for downconverting linearly and circularly polarized signals received by a single antenna or waveguide, wherein the linearly polarized signals have a different frequency than the circularly polarized signals, said method comprising:

(a) receiving vertically polarized components of the linearly and circularly polarized signals and receiving horizontally polarized components of the linearly and circularly polarized signals;

(b) amplifying the vertically and horizontally polarized components;

(c) separating each of the vertically and horizontally polarized components into first and second frequency bands, said first frequency bands corresponding to said linearly polarized signals and said second frequency bands corresponding to said circularly polarized signals;

(d) downconverting said first frequency bands;

(e) introducing phase shifts into said second frequency bands so as to separate left-hand and right-hand circularly polarized signals; and (f) downconverting said left-hand and right-hand circularly polarized signals.

15. The method of claim 14, wherein the linearly and circularly polarized signals are received by a waveguide having a first probe and a second probe, said first probe for receiving the vertically polarized components and said second probe for receiving the horizontally polarized components.

16. The method of claim 14, wherein the linearly polarized signal has a frequency in a range of 10.95–11.2 GHz and the circularly polarized signal has a frequency in a range of 12.2–12.7 GHz.

17. The method of claim 14, wherein the linearly and circularly polarized signals are transmitted by a single satellite.

18. The method of claim 14, wherein a right-hand circularly polarized signal, a left-hand circularly polarized signal, a vertical linearly polarized signal, and a horizontal linearly polarized signal are simultaneously downconverted.

19. The method of claim 14, wherein a plurality of signals are simultaneously downconverted, and wherein each one of said plurality of signals is a different one of a right-hand circularly polarized signal, a left-hand circularly polarized signal, a vertical linearly polarized signal, and a horizontal linearly polarized signal.

20. The method of claim 14, wherein the linearly polarized signal is of a lower frequency than the circularly polarized signal.

21. The method of claim 14, wherein the linearly polarized signals are downconverted to 1200–1450 MHz and the circularly polarized signals are downconverted to 1600–2100 MHz.

* * * * *